US009243486B2

(12) United States Patent
Nieuwoudt et al.

(10) Patent No.: US 9,243,486 B2
(45) Date of Patent: Jan. 26, 2016

(54) APPARATUS AND METHOD FOR DETERMINING CLOSURE PRESSURE FROM FLOWBACK MEASUREMENTS OF A FRACTURED FORMATION

(71) Applicants: Hermanus J. Nieuwoudt, Tomball, TX (US); James T. Cernosek, Missouri City, TX (US)

(72) Inventors: Hermanus J. Nieuwoudt, Tomball, TX (US); James T. Cernosek, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 350 days.

(21) Appl. No.: 13/775,427

(22) Filed: Feb. 25, 2013

(65) Prior Publication Data

US 2014/0238663 A1 Aug. 28, 2014

(51) Int. Cl.

| | |
|---|---|
| ***E21B 43/26*** | (2006.01) |
| ***E21B 47/06*** | (2012.01) |
| ***E21B 49/00*** | (2006.01) |

(52) U.S. Cl.

CPC ..... *E21B 43/26* (2013.01); *E21B 47/06* (2013.01); *E21B 49/008* (2013.01)

(58) Field of Classification Search

CPC ..... E21B 43/26; E21B 47/06

See application file for complete search history.

(56) References Cited

U.S. PATENT DOCUMENTS

| | | | | |
|---|---|---|---|---|
| 5,050,674 | A | 9/1991 | Soliman et al. | |
| 2003/0079875 | A1 | 5/2003 | Weng | |
| 2004/0020649 | A1 | 2/2004 | Fields | |
| 2006/0102342 | A1 * | 5/2006 | East et al. | 166/250.1 |
| 2007/0272407 | A1 * | 11/2007 | Lehman et al. | 166/250.1 |
| 2009/0250207 | A1 | 10/2009 | May | |
| 2010/0157737 | A1 * | 6/2010 | Miller et al. | 367/117 |
| 2010/0218941 | A1 * | 9/2010 | Ramurthy et al. | 166/250.1 |
| 2010/0223990 | A1 | 9/2010 | Simpson et al. | |

FOREIGN PATENT DOCUMENTS

| | | | |
|---|---|---|---|
| WO | 2013008195 | A2 | 1/2013 |
| WO | WO 2013008195 | A2 * | 1/2013 |

OTHER PUBLICATIONS

PCT International Search Report and Written Opinion; International Application No. PCT/US2014/018219; International Filing Date: Feb. 25, 2014; Date of Mailing: Jun. 20, 2014; pp. 1-14.

* cited by examiner

*Primary Examiner* — Frederick L Lagman

(74) *Attorney, Agent, or Firm* — Cantor Colburn LLP

(57) ABSTRACT

An apparatus for determining a closure pressure of a fractured formation surrounding a wellbore is disclosed. The apparatus, in one embodiment, includes an isolation device for isolating a section of the wellbore, a fluid supply unit for supplying a fluid from the wellbore under pressure into the isolated section of the wellbore to cause a fracture in the formation proximate the isolated section, a receiving unit for receiving fluid from the isolated section at a constant or substantially constant rate due to pressure difference between the formation and the receiving unit, and a sensor for determining pressure of the formation during receiving of the fluid into the receiving unit. The apparatus further includes a controller for determining the closure pressure from the determined pressure.

19 Claims, 4 Drawing Sheets

APPARATUS AND METHOD FOR DETERMINING CLOSURE PRESSURE FROM FLOWBACK MEASUREMENTS OF A FRACTURED FORMATION

BACKGROUND OF THE DISCLOSURE

1. Field of the Disclosure

The present disclosure relates generally to apparatus and methods for determining a closure pressure of a fractured formation.

2. Description of the Related Art

During both drilling of a wellbore and after drilling, fluid (oil, gas and water) from the formation is often extracted to determine the nature of the hydrocarbons in hydrocarbon-bearing formations. Fluid samples are often collected from formations at selected wellbore depths by a formation testing tool conveyed in the wellbore. The collected samples are analyzed to determine various properties of the fluid. Some formations, such as made of shale, have very low permeability (also referred to as "tight formations") and do not allow the formation fluid to flow into the wellbore when such formations are perforated to recover the hydrocarbons therefrom. Fractures, also referred to as micro-fractures are created in such formation to determine a geological characteristic of such formation. A useful characteristic or parameter of such formations is the closure pressure.

To determine the closure pressure in tight micro-fractured formations, a flow-back test (a test that involves flowing back the fluid from the fractured formation) can be used to determine the closure pressure of the formation. A deflection point in the pressure measurements made during the flow back test can be used to determine the closure pressure. During flow-back tests, it is desirable to draw the fluid from the formation into a testing tool at a constant or substantially constant flow rate. Such constant flow rates can be achieved by creating a positive pressure difference between the formation and a chamber in the tool receiving the fluid. Conventional formation testing tools are difficult to use for flow-back tests because such tools utilize reciprocating pumps, which pumps create a negative pressure between the formation and a receiving chamber in the tool. In addition, the reciprocating "strokes" of such pumps creates back pressure, which can obscure the clear identification of the deflection point in the pressure during the withdrawing of the fluid from the formation, which can lead to a large error in determining the closure pressure.

The disclosure herein provides an apparatus and method for determining the closure pressure of a fractured formation using a flow back test.

SUMMARY

In one aspect, an apparatus for determining a closure pressure of a fractured formation surrounding a wellbore is disclosed. The apparatus, in one embodiment, includes an isolation device for isolating a section of the wellbore, a fluid supply unit for supplying a fluid from the wellbore under pressure into the isolated section of the wellbore to cause a fracture in the formation proximate the isolated section, a receiving unit for receiving fluid from the isolated section at a constant or substantially constant rate due to pressure difference between the formation and the receiving unit, and a sensor for determining pressure of the formation during receiving of the fluid into the receiving unit. The apparatus further includes a controller for determining the closure pressure from the determined pressure.

In another aspect, a method of determining a closure pressure of a fractured formation surrounding a wellbore is disclosed. The method, in one embodiment, includes; isolating a section of the wellbore; supplying a fluid under pressure into the isolated section of the wellbore to cause a fracture in the formation; receiving fluid from the isolated section into a receiving unit due to a pressure difference between the isolated section and receiving unit at a constant or substantially constant rate; determining pressure of the formation while receiving the fluid into the receiving unit; and determining the closure pressure of the fractured formation from the determined pressure.

Examples of certain features of the apparatus and methods disclosed herein are summarized rather broadly in order that the detailed description thereof that follows may be better understood. There are, of course, additional features of the apparatus and methods disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, wherein.

DESCRIPTION OF THE FIGURES

Figure 1:
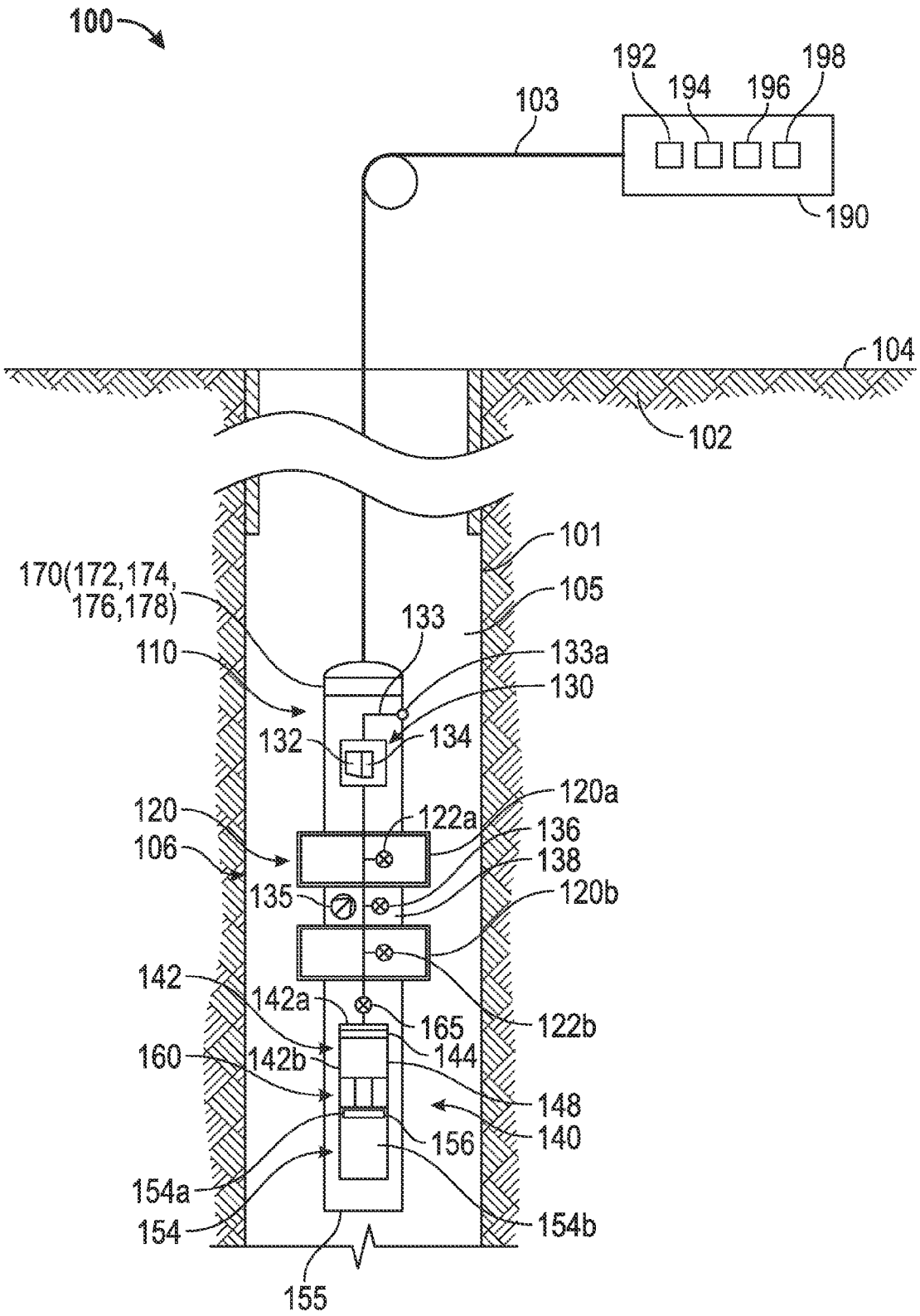
FIG. 1 is a schematic diagram of an exemplary formation testing system for determining the closure pressure of a fractured formation.

FIG. 1 is a schematic diagram of an exemplary formation testing or formation evaluation system 100 for determining one or more properties of a formation. The system 100 is particularly suited for determining formation pressures, such as the closure pressure of a fractured formation. The system 100 includes a downhole tool 110 conveyed or deployed in a wellbore 101 formed in a formation 102. In the particular embodiment of FIG. 1, the wellbore 101 is an open hole that is filled with a fluid 105, such as a drilling fluid used for drilling the wellbore 101. The pressure generated by the weight of the fluid 105 at any given depth of the wellbore 101 is greater than the pressure of the formation 102 at that depth. The pressure in the wellbore due to the weight of the fluid 105 is referred to as the hydrostatic pressure, which is greater than the pressure of the formation at that depth. The tool 110 is shown conveyed in the wellbore 101 from the surface 104 by a conveying member 103, such as a wireline, coiled tubing or a drilling tubular.

In one embodiment, the tool 110 includes an isolation device 120 for isolating a section 106 of the wellbore 101. In one aspect, the isolation device 120 may be straddle packer that includes a pair of spaced apart packers 120*a* and 120*b*. In their normal configuration, the packers 120*a* and 120*b* are in a collapsed position, as shown in FIG. 1, and their outside dimensions are smaller than the wellbore diameter. The tool 110 includes a power unit 130 that may include a pump 132 driven by a motor 134. The pump 132 is connected to a fluid line 133 having an inlet 133*a* in fluid communication with fluid 105 in the wellbore 101. The fluid line 133 is further connected to a fluid receiving unit or device 140, packer 120*a* via a flow control device 122*a*, and packer 120*b* via a flow control device 122*b*. A flow control device may be any suitable device that controls the flow of fluid, including, but not limited to a valve and a connector. A flow control device 136 is provided in the space 138 between the packers 120*a* and 120*b* to control the flow of the fluid 105 from the pump 132 into the space 138. A pressure sensor 135 provides pressure measurements of the fluid in the space 138 and thus the formation pressure proximate the space 138.

The fluid receiving device or unit 140, in one embodiment, includes a first chamber 142, wherein a piston 144 divides the chamber 142 into a first chamber section 142*a* for receiving a fluid and a second chamber section 142*b* that is filled with a known fluid 148, such as oil. In the inactive mode, the piston 144 in chamber 142 is at the uppermost location as shown in FIG. 1 and the first chamber section 142*a* is empty. A flow control device 165 in line 133 may be provided to control the flow of a fluid into the chamber section 142*a*, and thus the receiving unit 140. The fluid receiving unit 140 further includes a second chamber 154 that has a piston 156 therein that divides the chamber 154 into a first chamber section 154*a* and a second chamber section 154*b*. The second chamber section 154*b* is filled with a compressible fluid 155, such as nitrogen gas. A flow control device 160 in fluid communication with the fluid line 133 on one side of the flow control device and the chamber section 142*a* on the other side controls the flow of the fluid into the chamber section 142*a*. In one embodiment, the flow control device 160 is a constant or substantially constant flow control device, regardless of the pressure of the fluid, such as constant flow control valve. Any suitable device may be used to control the flow of the oil 146 into the chamber 154*a* at a constant or substantially constant rate, including, but not limited to a constant flow rate valve and an electronically-controlled flow control device.

The tool 110 may include a controller 170 that further includes circuits 172 for processing data, such as signals from the various sensors in the tool, a processor 174, such as a microprocessor, a data storage device 176 and programs 178 stored in the storage device 174 containing instructions for the processor 174. A controller 190 also may be provided at a surface location that in one aspect may be a computer-based device. The controller 190 may include circuits 192 for processing various signals relating to the tool 110, a processor 194, data storage device 196 and programs containing instruction for the processor 194. In one aspect, the controller 170 may be programmed to execute one or more operations of the tool 110 and to processes signals from various sensors in the tool 110, including the pressure sensor 135. In another aspect, such functions may be performed by the surface controller 190. In another aspect, the controller 170 and 190 are in a two-way communication and may control certain functions separately and others jointly. A method of operating the system 100 to create one or more fractures in the formation 102 and for determining the closure pressure of such fractured formation is described in more detail in reference to FIGS. 2-4.

Figure 2:
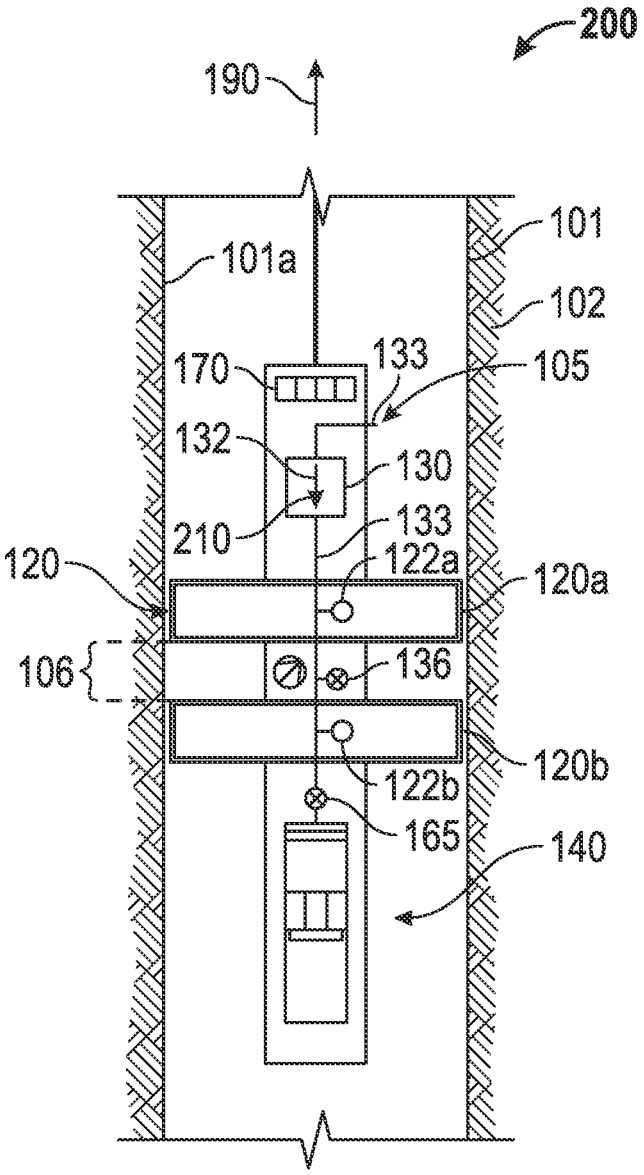
FIG. 2 shows the downhole tool shown in FIG. 1 when an isolation device in the downhole tool is setting packers to isolate a section of the wellbore.

FIG. 2 shows system 100 of FIG. 1 when the isolation device 120 is being activated to isolate the section 106 of the wellbore 101. To isolate section 106, flow control device 122*a* and 122*b* are opened and flow control devices 136 and 160 are closed. The pump 132 is activated, which draws the fluid 105 from the wellbore 101 into line 133 and supplies such fluid under pressure to the packer 120*a* via flow control device 122*a* and packer 120*b* via flow control device 122*b* to inflate the packers 120*a* and 120*b* as shown in FIG. 2. The packers 120*a* and 120*b* expand radially and press against the inside wall 101*a* of the wellbore 101. The flow control devices 122*a* and 122*b* are closed and the pump 132 is deactivated to set the packers 120*a* and 120*b* in the wellbore 101, which isolates section 106 from the rest of the wellbore 101. Controller 170 and/or 190 may be utilized for closing and opening the flow control device 122*a* and 122*b* and the pump 132 to set the packers 120*a* and 120*b*.

Figure 3:
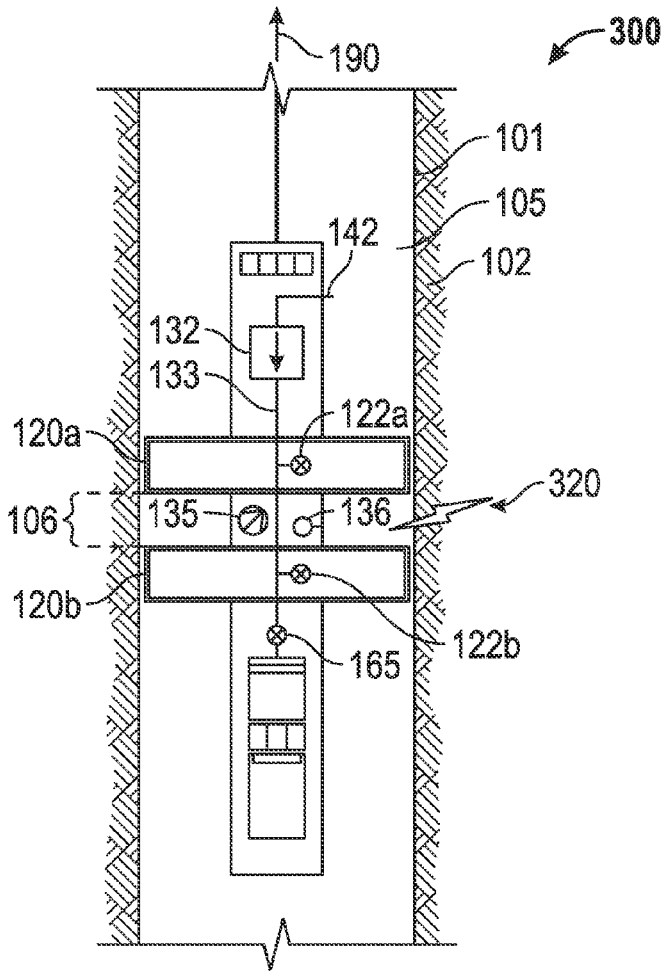
FIG. 3 shows the downhole tool shown in FIG. 2 when the downhole tool is in the process of fracturing the formation.
Figure 3A:
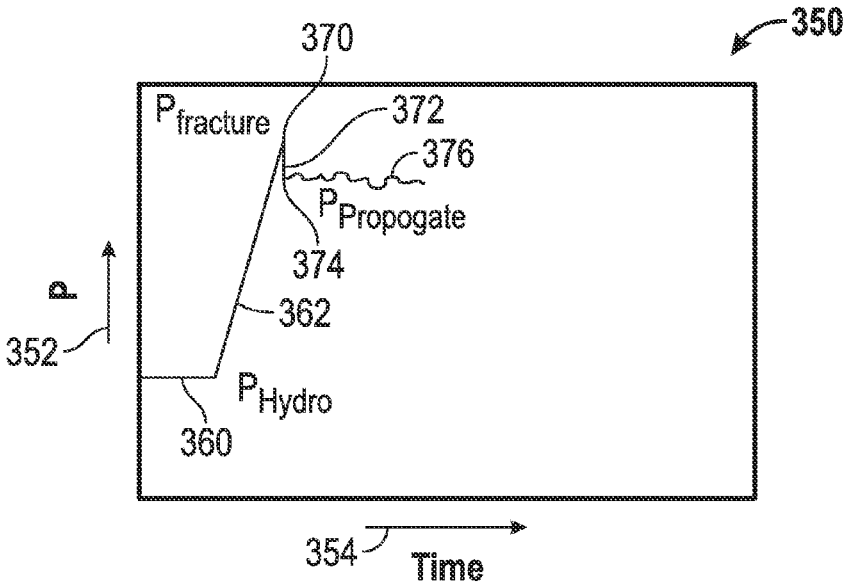
FIG. 3A shows a plot of the pressure of the formation over time when the formation is being fractured.

FIG. 3 shows a configuration 300 of the system 100, when the tool 110 is operated to create fractures 320 (also referred as micro-fractures) in the formation 102 proximate the isolated section 106. To create fractures 320, flow control devices 122*a*, 122*b* and 165 remain closed and flow control device 136 is opened, which combination of flow control devices causes the isolated section 106 to be in fluid communication with line 133 and thus fluid 105 in the wellbore 101. The pump 132 is then activated to supply fluid 105 under pressure from the wellbore to the isolated section 106. The pressure of the supplied fluid is sufficient to cause micro-fractures 320 to occur. The pressure sensor 135 provides the pressure measurements during the fracturing process. FIG. 3A show a pressure versus time plot showing the measured pressure during the fracturing process. The measured pressure 352 is shown along the ordinate (vertical axis) and the time 354 is shown along abscissa (horizontal axis). Prior to pumping the fluid 105 into the section 106, the pressure in the isolated section 106 is the same as the hydrostatic pressure, as shown by the constant line 360. As the fluid 105 is supplied under pressure by the pump 132 into the section 106, the pressure rises and continues to rise as shown by line 362. When the pressure is sufficiently above the pressure of the formation 102, fractures 320 occur. The pressure at which the fractures 320 occur (the "fracture pressure") is shown by numeral 370. Once the fractures 320 occur, fluid from the isolated section 106 migrates into the fractures 320 causing the pressure in the section 106 to decrease to a propagation pressure 374 somewhat rapidly, as shown by line 372. The pressure then stabilizes to a substantially constant pressure 376.

Figure 4:
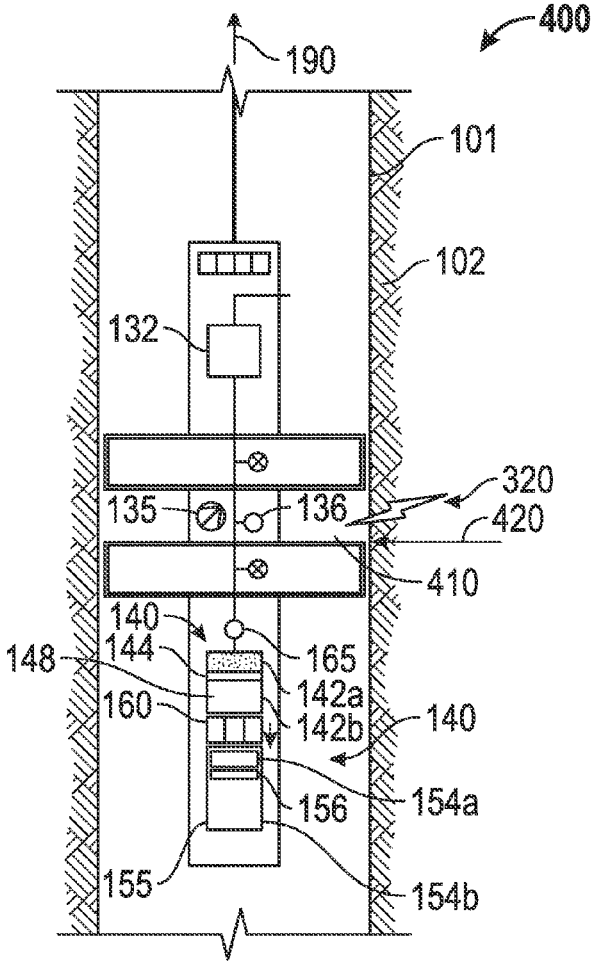
FIG. 4 shows the downhole tool shown in FIG. 3 as a flow back test is being conducted.

FIG. 4 shows a configuration 400 of the tool 110 shown in FIG. 3 during drawdown of the fluid from the isolated section 106 into the receiving unit 140 for determining the closure pressure of the fractured formation 102. To determine the closure pressure of the formation 102, pump 132 is deactivated. The flow control devices 122*a* and 122*b* remain closed. Flow control devices 160 and 165 are then opened, which causes the isolated section 106 and thus the fractures 320 to be in fluid communication with the chamber section 142*a* of the collection chamber 140. The pressure in the chamber section 142*a* is the sum of the original pressure therein (i.e., the atmospheric pressure) and the pressure applied by the fluid 155 in the chamber section 154*b* of the chamber 154. The pressure in the chamber 142*a* at all times is lower than the pressure in the isolated section 106. Therefore, the fluid 410 from the isolated section 106 starts to flow into the chamber section 142*a* due to the difference in the pressure between the isolated section 106 and the pressure in the chamber section 142*a*. The flow control device 160 maintains the flow of the fluid 410 into the chamber section 142*a* at a constant or substantially constant rate. The fluid 410 entering the chamber 142*a* causes the piston 144 to move, which moves the fluid 148 to move into the chamber section 154*a* of chamber 154 via the flow control device 160. The fluid 148 entering the chamber section 154*a* moves the piston 156, which compresses the gas 155 in the chamber 154*b*. As fluid 410 is being withdrawn from section 106, the fluid 420 from the fractures 320 moves from the formation 102 toward the isolated section 106, which reduces the pressure of the formation 102. This process of withdrawing the fluid 420 from the formation is referred to as flow back or flow back process.

Figure 4A:
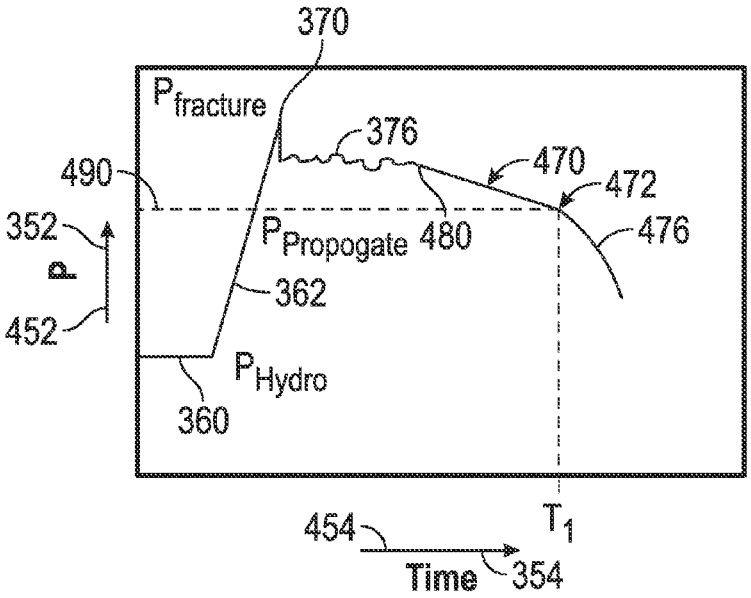
FIG. 4A shows a plot of the pressure of the formation over time during the flow back test.

FIG. 4A shows a graph 450 of pressure versus time during the flow back process. FIG. 4A is the same as FIG. 3A, except that it includes the pressure measurements during the flow back process. Once the fluid starts to flow from the isolated section 106 into the receiving unit 140, the pressure of the formation stars to drop, starting a point 480. The pressure continues to drop at a substantially constant rate because the fluid is being withdrawn at a constant or substantially constant rate. At a certain time thereafter, the rate of pressure drop increases, as shown by point 472. This change in the rate occurs because the fractures have closed. The point 472 is referred to as the inflection point and the corresponding pressure 490 is referred to as the closure pressure. The controller 170 and/or 190 determines and monitors the pressure of the formation and determines the inflection point and thus the closure pressure.

While the foregoing disclosure is directed to the embodiments of the disclosure, various modifications will be apparent to those skilled in the art. It is intended that all variations within the scope and spirit of the appended claims be embraced by the foregoing disclosure.

The invention claimed is:

1. An apparatus for determining closure pressure of a formation surrounding a wellbore, comprising:

an isolation device for isolating a section of the wellbore;

a fluid supply unit for supplying a fluid under pressure into the isolated section of the wellbore to cause a fracture in the formation proximate the isolated section; and a receiving unit for receiving fluid from the isolated section due to pressure difference between the formation and the receiving unit, wherein the receiving unit includes a constant or substantially constant flow control device that controls the rate of flow of the fluid into the receiving unit.

2. The apparatus of claim 1, further comprising a sensor for providing signals representative of a pressure in the isolated section.

3. The apparatus of claim 2, further comprising a controller for:

determining the pressure in the isolated section from the signals provided by the sensor while the fluid from the isolated section is being received in the receiving unit; and determining a closure pressure of the formation from the determined pressure.

4. The apparatus of claim 3, wherein the controller determines an inflection point in the determined pressure and determines the closure pressure from the inflection point.

5. The apparatus of claim 1 further comprising:

a pump for supplying a fluid from the wellbore into the isolated section under pressure to cause the fracture in the formation; and a flow control device for controlling the flow of the fluid from the pump into the isolated section.

6. The apparatus of claim 1, wherein the receiving unit includes a collection chamber having a movable member that divides the collection chamber into a first section that receives the fluid from the isolated section and a second section that contains a known fluid.

7. The apparatus of claim 1, wherein the constant or substantially constant flow control device in a closed mode prevents flow of the fluid form the isolated section into the collection chamber and in a second mode allows the fluid from the isolated section into the collection chamber at a constant or a substantially constant flow rate.

8. The apparatus of claim 6, wherein the receiving unit further includes a force application device that applies a selected force onto the fluid in the second section of the collection chamber when the fluid from the isolated section is collected into the first section of collection chamber.

9. The apparatus of claim 6, further comprising a flow control device for controlling the flow of the fluid from the isolated section into the first section of the collection chamber.

10. The apparatus of claim 1, further comprising a controller for controlling at least one of: setting of the isolation device for isolating the section of the wellbore; supply of the fluid from the wellbore into the isolated section; and supply of the fluid from the isolated section into the collection chamber.

11. The apparatus of claim 1, further comprising a controller that is programmed to:

open a first valve to set the isolation device in the wellbore;

close the first valve and open a second valve to supply a fluid under pressure into the isolated section; and close the second valve and open a third valve to allow the fluid to flow from the isolated section to the receiving unit.

12. An apparatus for use in a wellbore for determining closure pressure of a formation surrounding a wellbore, comprising:

a tool conveyable into the wellbore, wherein the tool includes:

an isolation device for isolating a section of the wellbore;

a fluid supply unit for supplying a fluid under pressure into the isolated section of the wellbore to cause a fracture in the formation proximate the isolated section;

a receiving unit for receiving fluid from the isolated section due to a pressure difference between the isolated section and the receiving unit at a constant or substantially constant flow rate, wherein the receiving unit includes a constant or substantially constant flow control device that controls the rate of the flow of the fluid into the receiving unit; and a sensor for providing measurements relating to a pressure of the isolated section for determining a closure pressure of the fracture in the formation.

13. A method of determining a closure pressure of a formation surrounding a wellbore, comprising:

isolating a section of the wellbore;

establishing a fluid communication between the isolated section and a receiving unit that is at a pressure lower than the pressure in the isolated section;

receiving fluid from the isolated section into the receiving unit due to a pressure difference between the isolated section and the receiving unit at a constant or substantially constant rate;

determining a pressure of the formation while receiving the fluid into the receiving unit; and determining the closure pressure of the formation from the determined pressure.

14. The method of claim 13, wherein determining the closure pressure comprises determining a change in the in the pressure while receiving the fluid into the receiving unit.

15. The method of claim 14, wherein the change in the pressure corresponds to an inflection point in the pressure.

16. The method of claim 13, further comprising supplying a fluid under pressure into the isolated section of the wellbore to cause a fracture in the formation proximate the isolated section.

17. The method of claim 13, wherein the receiving unit includes a collection chamber and receiving the fluid further includes flowing the fluid from the isolated section into the collection chamber at the constant or substantially constant rate.

18. The method of claim 13, wherein determining the closure pressure comprises using a controller to determine an inflection point in the measured pressure while receiving the fluid from the isolated section into the receiving unit and determining the closure pressure from the inflection point.

19. The method of claim 13, wherein the receiving unit includes: a first chamber that includes a movable piston that divides the first chamber into a first chamber section and a second chamber section that includes a known fluid; a constant flow control device in fluid communication with the known fluid in the second chamber section; and a second chamber containing a second piston that divides the second chamber into a third chamber section for receiving the known fluid from the second chamber section and a fourth chamber section that contains a compressible fluid, wherein receiving the fluid into the receiving unit comprises:

opening a valve between the isolated section and the first chamber section to cause the fluid from the isolated section to enter the first chamber section to cause the first piston to move the known fluid from the second chamber section into the third chamber section via the constant flow device.

* * * * *